US005524570A

United States Patent [19]

Kaye

[11] Patent Number: 5,524,570

[45] Date of Patent: *Jun. 11, 1996

[54] COLLAPSIBLE BOAT

[76] Inventor: Alex R. Kaye, 88 Shearer Dr., Atherton, Calif. 94025

[ * ] Notice: The term of this patent shall not extend beyond the expiration date of Pat. No. 5,372,085.

[21] Appl. No.: 338,294

[22] Filed: Nov. 14, 1994

Related U.S. Application Data

[62] Division of Ser. No. 121,095, Sep. 14, 1993, Pat. No. 5,372,085, which is a continuation of Ser. No. 893,878, Jun. 5, 1992, abandoned.

[51] Int. Cl.[6] ..... B63B 7/00

[52] U.S. Cl. ..... 114/353; 114/354

[58] Field of Search ..... 114/343, 352, 114/354, 355, 39.1, 126, 169, 363

[56] References Cited

U.S. PATENT DOCUMENTS

| | | | |
|---|---|---|---|
| 2,346,081 | 4/1944 | Randrup | 114/354 |
| 2,504,256 | 4/1950 | Dittrich | 114/354 |
| 2,830,308 | 4/1958 | Green | 114/354 |
| 2,880,429 | 4/1959 | Henry | 114/354 |
| 3,529,312 | 9/1970 | Robinsky | 114/354 |
| 3,648,309 | 3/1972 | Novakovich | 114/354 |

FOREIGN PATENT DOCUMENTS

| | | |
|---|---|---|
| 18-6826 | 6/1943 | Japan . |
| 32-1033 | 3/1957 | Japan . |
| 32-1034 | 3/1957 | Japan . |
| 49-24873 | 7/1974 | Japan . |

*Primary Examiner* Stephen Avila
*Attorney, Agent, or Firm* Townsend and Townsend and Crew

[57] ABSTRACT

A boat having bottom and side panels. A yieldable diaphragm has a seal between the diaphragm and the panels. A motor mount on a rear seat board projects rearwardly and beyond the diaphragm to present a support for a motor. A sailboat has a rudder controlled by a tiller. Another motor mount is rotatably mounted on the sides of the boat so that it serves as a seat or a mounting panel for a boat. A diaphragm can be placed on the bottom of the boat and then shifted rearwardly so that tongues or projections of rubber on the bottom and sides of the diaphragm can be moved rearwardly and received in sealing relationship with forwardly facing, open end slots on the bottom and side panels of the boat.

3 Claims, 7 Drawing Sheets

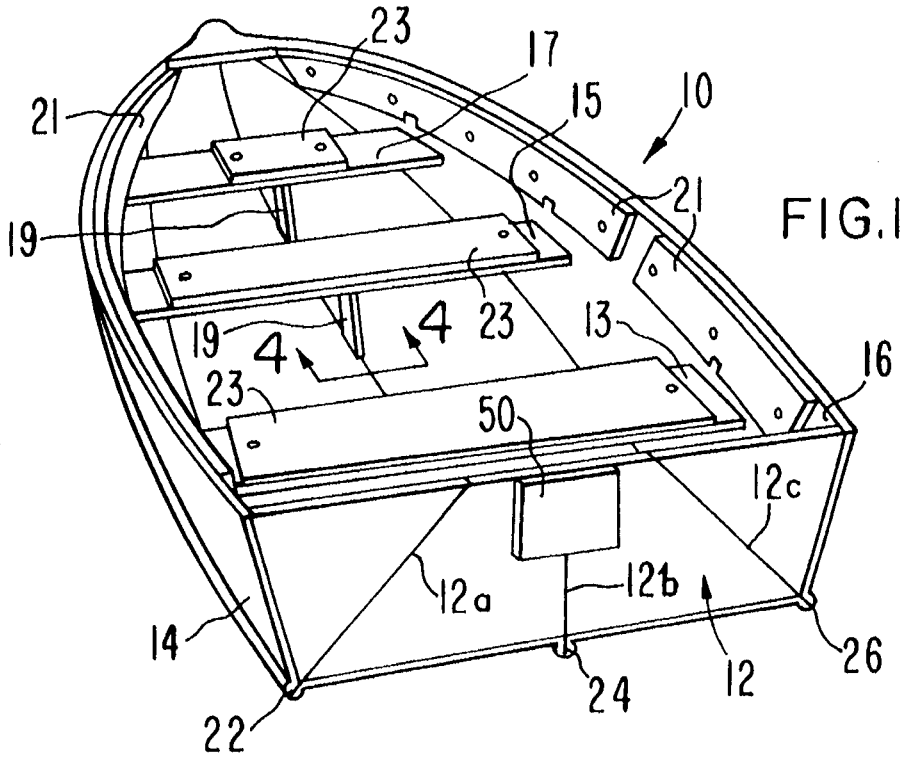
FIG.1
FIG.2
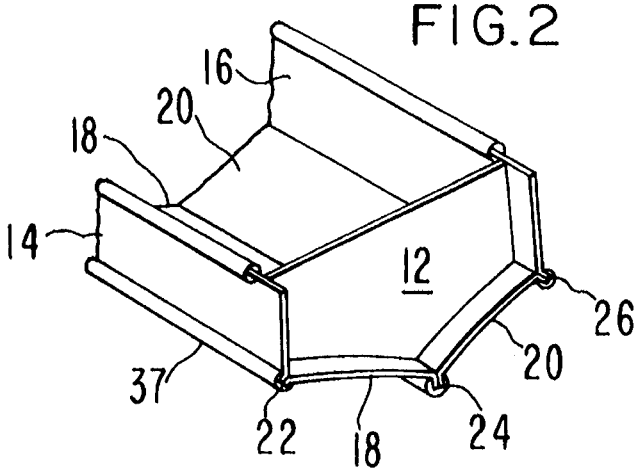
FIG.3
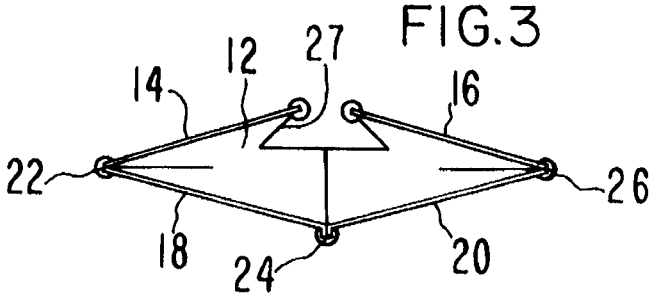

COLLAPSIBLE BOAT

This is a divisional of U.S. patent application Ser. No. 08/121,095, filed Sep. 14, 1993, which issued as U.S. Pat. No. 5,372,085 on Dec. 13, 1994, which in turn was a continuation of U.S. patent application Ser. No. 07/893,878, filed Jun. 5, 1992, now abandoned.

This invention relates to improvements in boats of small size and, more particularly, to a collapsible boat which can be folded into a substantially flat condition for carrying on the side or top of a vehicle.

BACKGROUND OF THE INVENTION

Collapsible boats are well known in the boating field. Disclosures of collapsible boats are found in the following U.S. Pat. Nos.:

4,911,095; 2,346,081; 2,353,013; 3,032,784; 3,108,295; 3,139,634; 3,228,042; and 3,648,309.

A main aspect of collapsible boats is the transom area of the boat. It is important that the junction between the transom and the bottom and side panels of the boat is leak-proof. Also, it is important that provision be made to mount an outboard motor on the transoms. This is true, for the most part, because most small boats are powered by such a motor rather than by the use of oars.

Because of the continuing need for boats of this type for sportsmen and the like, improvements are always sought, and the present invention provides several improvements in the field of collapsible boats which represent distinct advances over the prior art.

SUMMARY OF THE INVENTION

The present invention is directed to an improved collapsible boat having several different improvements which render the boat especially suitable for use on all types of water courses using an outboard motor rather than oars. The present invention uses a boat having a pair of hingedly interconnected lower or bottom panels and a pair of side panels hinged to respective bottom or lower panels, there being a flexible or yieldable diaphragm or flexible transom which uses a unique seal for connecting the diaphragm or flexible transom to the panels of the boat.

The improvements further include the provision of a motor mount which is associated with a rear seat board wherein a metallic plate having several angles is attached to the seat and projects rearwardly therefrom and beyond the diaphragm to present a vertical block or support to which the motor can be removably attached.

The features and improvements of the present invention can also be used with a sailboat having a rudder controlled by a tiller with the tiller being rotatably mounted in some suitable manner on the yieldable or flexible diaphragm.

Another version of the shiftable motor mount is one in which the transverse cross section of the motor mount is triangular and the mount can be rotatably mounted in one of two positions on the sides of the boat so that, when the mount is in one position, it serves as a seat directly forwardly of the diaphragm and, in the other position, it serves as a mounting panel for the essential part of the mount while the forward parts of the member also serve as a seat as well. The diaphragm can be made to accommodate rigid panels which fold with the diaphragm itself and which rigidify and stabilize the diaphragm such as when it is desirable to mount a motor on the diaphragm.

Another aspect of the invention is the provision of a rigid transom which can be lowered into position on the bottom of the boat and then shifted rearwardly so that tongues or projections on the rear surface portions of the transom can be moved rearwardly and received in sealing relationship with forwardly facing open end grooves or slots on the bottom and side panels of the boat. Thus, in a two step process, the transom can be lowered into place, and then moved rearwardly. The tongues on the transom can be of yieldable or resilient material, such as rubber or the like, so as to make a liquid tight fit which is waterproof and which can withstand long periods of time in the water for keeping the interior of the boat substantially dry at all times.

The primary object of the present invention is to provide an improved collapsible boat which has a diaphragm which can be flexible as well as rigid and which accommodates motor mounts which can project rearwardly from the diaphragm yet the boat is substantially sealed at all locations to prevent leakage of water into the boat so as to render it sea worthy notwithstanding the simplicity of the construction of the seals at the sides and bottoms of the boat.

Other objects of the present invention will become apparent as the following specification progresses, reference being had to the accompanying drawings for an illustration of the invention.

IN THE DRAWINGS

FIG. 1 is a perspective view of an improved collapsible boat of the present invention;

FIG. 2 is a fragmentary, perspective view of the boat showing the foldable diaphragm at the rear of the boat;

FIG. 3 is a schematic view of the rear of the boat, showing the way in which the panels are hinged or folded to collapse the boat;

DETAILED DESCRIPTION OF THE DRAWINGS

Figure 4:
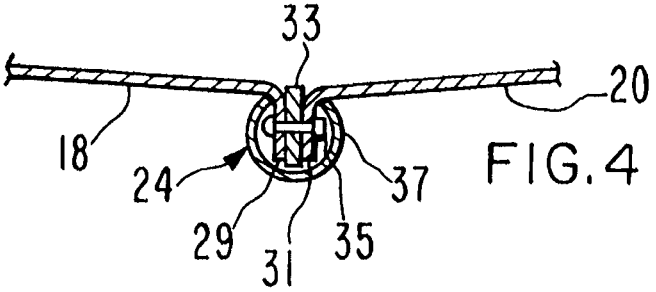
FIG. 4 is an enlarged, cross-sectional view taken along line 4—4 of FIG. 1.

A collapsible boat of the present invention is broadly denoted by the numeral 10 and includes a rear, foldable diaphragm 12 which serves somewhat as a yieldable transom in certain applications as hereinafter described. Boat 10 further includes a pair of side panels 14 and 16 which have means forming hinge lines 22 and 26 connecting respective bottom panels 18 and 20, to side panels 14 and 16, and means for forming a hinge line 24 interconnecting panels 18 and 20. The boat collapses in the manner shown in FIG. 3 in that panels 14 and 16 overlie respective panels 18 and 20 and panels 14 and 16 are naturally biased into their closed positions by virtue of the hinged connections 22 and 26.

When boat 10 is collapsed, diaphragm 12 is foldable along lines of weakness 12*a*, 12*b* and 12*c* as shown in FIGS. 1 and 2. When collapsed, the boat can be carried in a compact, substantially flat condition on the side or top of a vehicle.

To assemble the boat, panels 14 and 16 are moved apart with respect to panels 18 and 20 and board seats 13, 15 and 17 are put into place spanning the side panels 14 and 16 as shown in FIG. 1 so as to hold the sides panels 14 and 16 apart. Each of the board seats has a leg or strut 19 which is secured to the underside of the board seat and extends downwardly and snugly fits into the crevice formed by the connection of panels 18 and 20 along a longitudinal fore and aft hinge line 24. Foam panels 21 can be used on the inner side surfaces of sides 14 and 16 for buoyancy purposes. The board seats may have foam pads 23 for this same purpose. A block 25 is shown in the central opening 27 (FIG. 3) of diaphragm 12 to illustrate how a motor mount block would look from the rear of the boat if the mount were put into place in some suitable manner.

Figure 5:
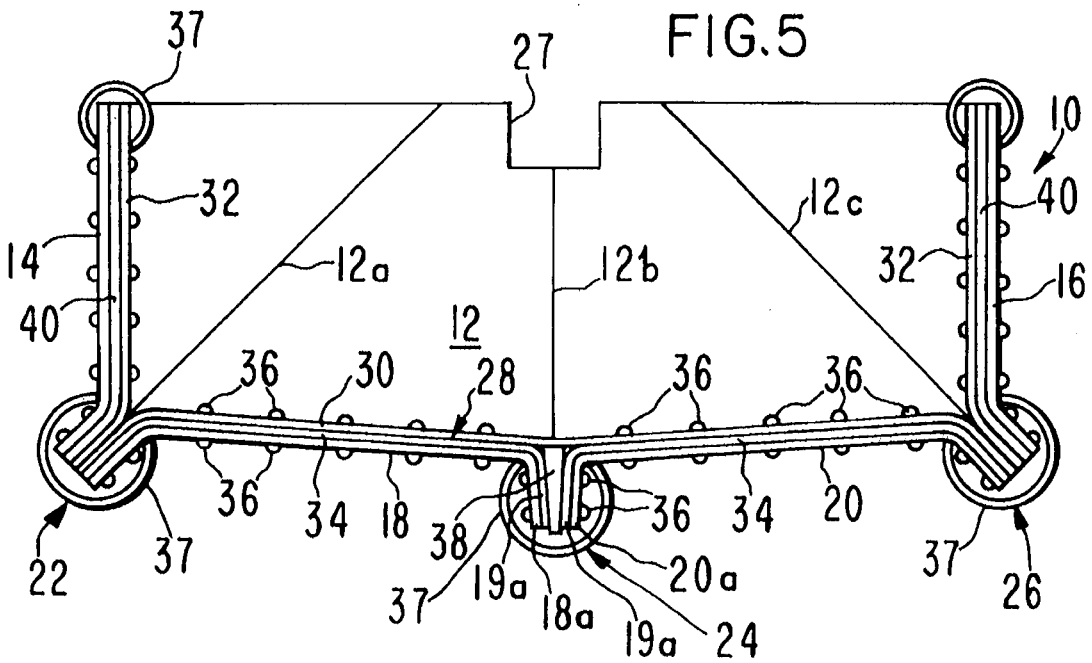
FIG. 5 is a rear elevational view of the boat.

Hinge lines 22, 24 and 26 are all essentially of the same construction as shown in FIG. 4. Hinge line 24 is formed from a pair of central flanges 29 and 31 on bottom panels 18 and 20. A double backed adhesive tape 33 is placed between flanges 29 and 31 and the flanges are pressed together by fastener means 35 which may be staples, bolts or the like. Thus, flanges 29 and 31 and tape 33 form a watertight seal extending lengthwise of the boat and substantially to the ends of the boat. The seals are formed at hinge lines 22, 24 and 26. A boot 37 is placed in surrounding relationship to each hinge line, respectively, to enhance or at least cover the watertight seal formed as described above. Boots 37 are at other locations on the boat as shown in FIGS. 2 and 5.

A seal 28 is formed between diaphragm 12 and the side panels 14 and 16 and the bottom panels 18 and 20. To this end, diaphragm 12 has a lower flange 30 and a pair of side flanges 32, lower flange 30 overlying two tape strips 34, the tape strips being of double backed adhesive tape and the tape strips being in engagement with bottom panels 18 and 20, respectively. Fasteners 36, such as staples, bolts or the like, clamp the flange 30 to bottom panels 18 and 20.

Figure 7:
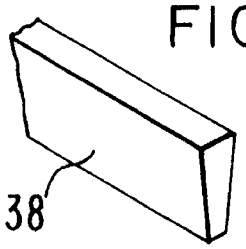
FIG. 7 is a perspective view of a foam plastic insert for forming a seal at the central parts of the bottom panels of the boat.

At the center of the boat, bottom panels 18 and 20 have flanges 18a and 20a which are secured by fasteners 36 to each other and to a compressed foam seal 38 shown in an uncompressed state in FIG. 7. Foam member 38, when compressed to the configuration shown in FIG. 5, seals the junction between flanges 18*a* and 20*a* of bottom panels 18 and 20. A pair of double backed adhesive tape segments 19*a* are between the seal 38 and the adjacent flanges 18*a* and 20*a*. Seal 38 is in the range of 1" to 2" in length and initially has a wedge-shape configuration as shown in FIG. 7.

Figure 6:
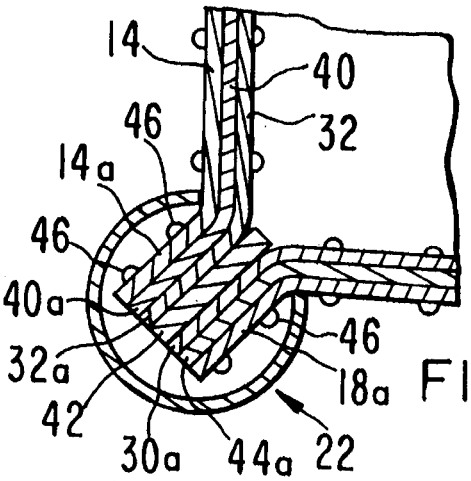
FIG. 6 is an enlarged cross-sectional view of one junction between a bottom panel of the boat and a side panel of the boat.

FIG. 6 shows the detail of the hinge line 22 which is the same as hinge line 26. To this end, side 14 has a flange 14*a* adjacent to a tape segment 40*a* which is also adjacent to the flange 32 of diaphragm 12. Flange 32 has a segment 32*a* which engages tape segment 40*a* on one side and with a segment 42 of double backed adhesive tape on the other side. Flange 30 of diaphragm 12 has a flange 30*a* which engages segment 42 on one side and with flange 44*a* of tape 34 between flange 30 and the bottom panel 18. Fasteners 46 secure the assembly of flanges and segments in place. The structure of FIG. 6 provides a watertight joint at each of hinge lines 22 and 26, yet allows the boat 10 to fold in the manner shown in FIG. 3.

Figure 8:
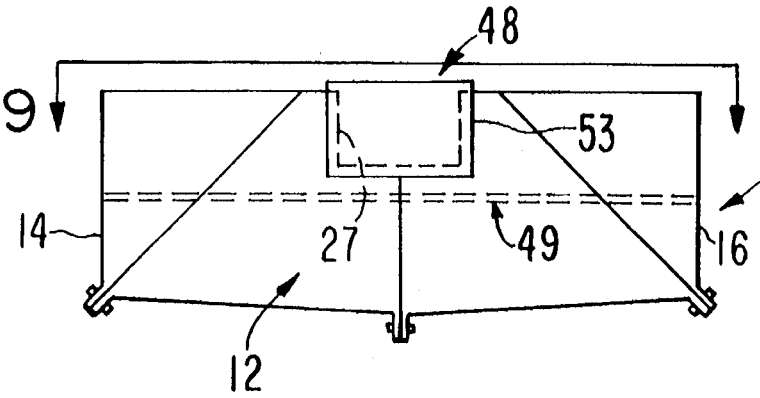
FIG. 8 is a view similar to FIG. 5 but showing an improved motor mount for the foldable diaphragm at the rear of the boat.
Figure 9:
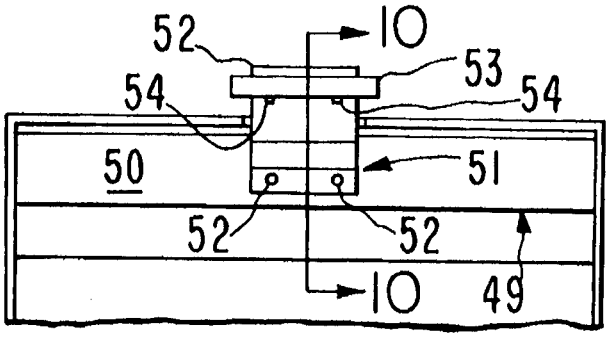
FIG. 9 is a top plan view of the motor mount and boat of FIG. 8.
Figure 10:
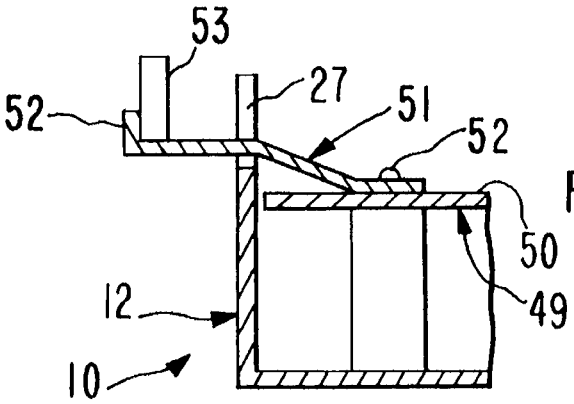
FIG. 10 is a cross-sectional view taken along line 10—10 of FIG. 9.

FIGS. 8–10 show a motor mount assembly 48 for a boat 10 having hole or opening 27 formed therein. To this end, a seat 49 removably spans the distance between sides 14 and 16 and presents a horizontal flat surface 50 (FIG. 10) to which an angled, metallic member 51 can be secured by fasteners 52. The member 51 is located centrally of seat 49 and extends upwardly and rearwardly therefrom through hole 27 and to a right angle extension 52 at the rear end of member 51. A wooden block 53 is secured to and extends vertically from the upper portion of member 51. Block 53 is used to mount an outboard motor on boat 10. Fasteners 54 secure the extension 53 to member 51.

Figure 11:
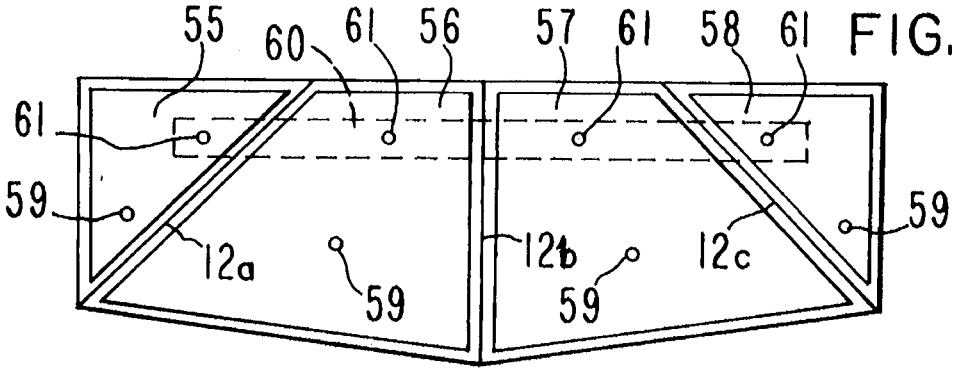
FIG. 11 is a view similar to FIG. 5 showing the diaphragm supported by rigid panels yet the diaphragm is foldable in the manner shown in FIG. 3.

To strengthen diaphragm 12 of boat 10, the diaphragm can be provided with rigid panels 55, 56, 57 and 58 as shown in FIG. 11. These panels are substantially of the same shape as the diaphragm parts to which they are secured. These panels fold with the diaphragms when the boat is to be collapsed. These panels do not interfere with the hinging of the diaphragm along its lines of weakness 12*a*, 12*b* and 12*c*. Fasteners 59 can be used to secure the panels 55–58 to the diaphragm.

To rigidify the diaphragm when the boat is expanded into its operating condition, a rigid board 60 can be removably coupled by fasteners 61 to the diaphragm to strengthen the connection between the panels 55–58 and the diaphragm. The board 60 can be of wood or metal and can quickly be taken off and placed on the diaphragm to allow the diaphragm to collapse or expand.

Figure 12:
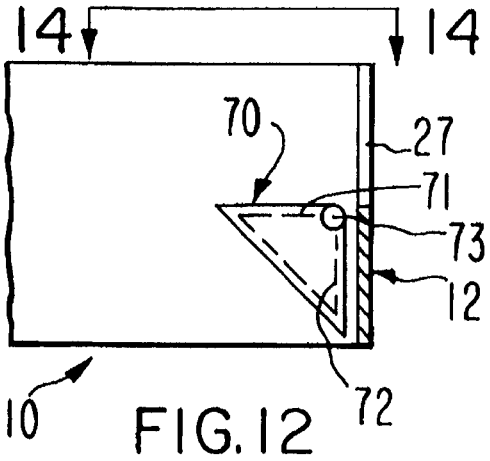
FIG. 12 is a schematic side elevational view of another embodiment of the motor mount of the present invention, the motor mount being a rotatable seat-like member in a storage position.
Figure 13:
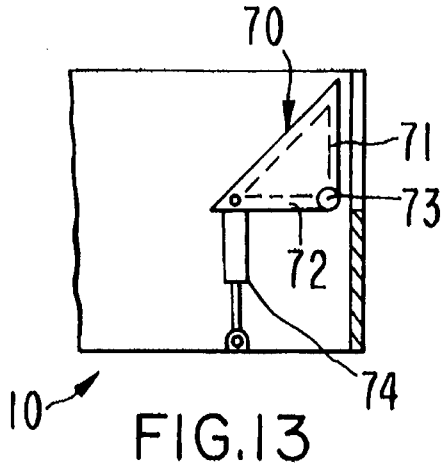
FIG. 13 is a view similar to FIG. 12 but showing the member in a motor mount operating position with respect to the rear diaphragm.
Figure 14:
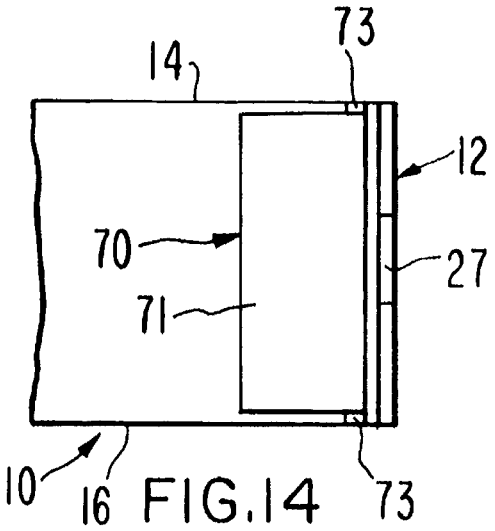
FIG. 14 is a top plan view of the motor mount member in FIG. 13 as attached by a pivot axis to the side panels of the boat near the diaphragm.

Another type of motor mount is shown in FIGS. 12–14 in which a seat member 70 having a first panel 71 is hingedly secured to a second panel 72 to form a right angle connection between the panels 71 and 72. A shaft 73 is secured to member 70 at the junction of panels 71 and 72 and the ends of the shaft are pivotally secured in some suitable manner to the sides 14 and 16 of the boat 10 as shown in FIG. 14.

When a motor is not to be used, member 70 is in the operative position shown in FIG. 12 in which the upper surface of member 71 can serve as a seat. The hole 27 in diaphragm 12 is not used.

When it is desired to mount the motor on boat 10, member 70 is rotated in a clockwise sense when viewing FIG. 12 in a quarter turn into the position shown in FIG. 13. A motor can then be attached to panel 71. One or more braces 74 can be provided to prevent movement of the member 70 while a motor is secured to the panel 71. FIG. 14 shows that panel 71 is adjacent to opening 27 so that a motor can readily be attached to panel 71 and project rearwardly from the diaphragm 12.

Figure 14A:
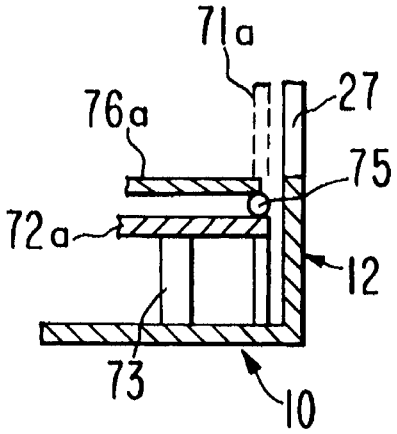
FIGS. 14A and 14B are vertical section and perspective views of another embodiment of a motor mount similar to the motor mount of FIGS. 12–14.
Figure 14B:
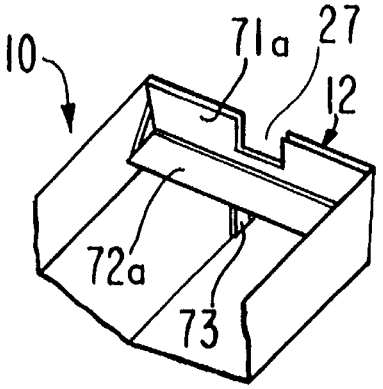

FIGS. 14A and 14B show a seat 72*a* for a boat 10 having a transom 12. A leg 73 supports seat 72*a* on the bottom of the boat. A seat board 71*a* is mounted by a pivot 75 on board 72*a* so that board 71*a* can moved either from the dashed line position shown in FIG. 14A to the full line position. In the dashed line position, the seat 71*a* can serve as a motor mount. In the full line position of FIG. 14A, the seat 71*a* can serve as an additional seat which is superimposed on seat 72*a*.

Figure 15:
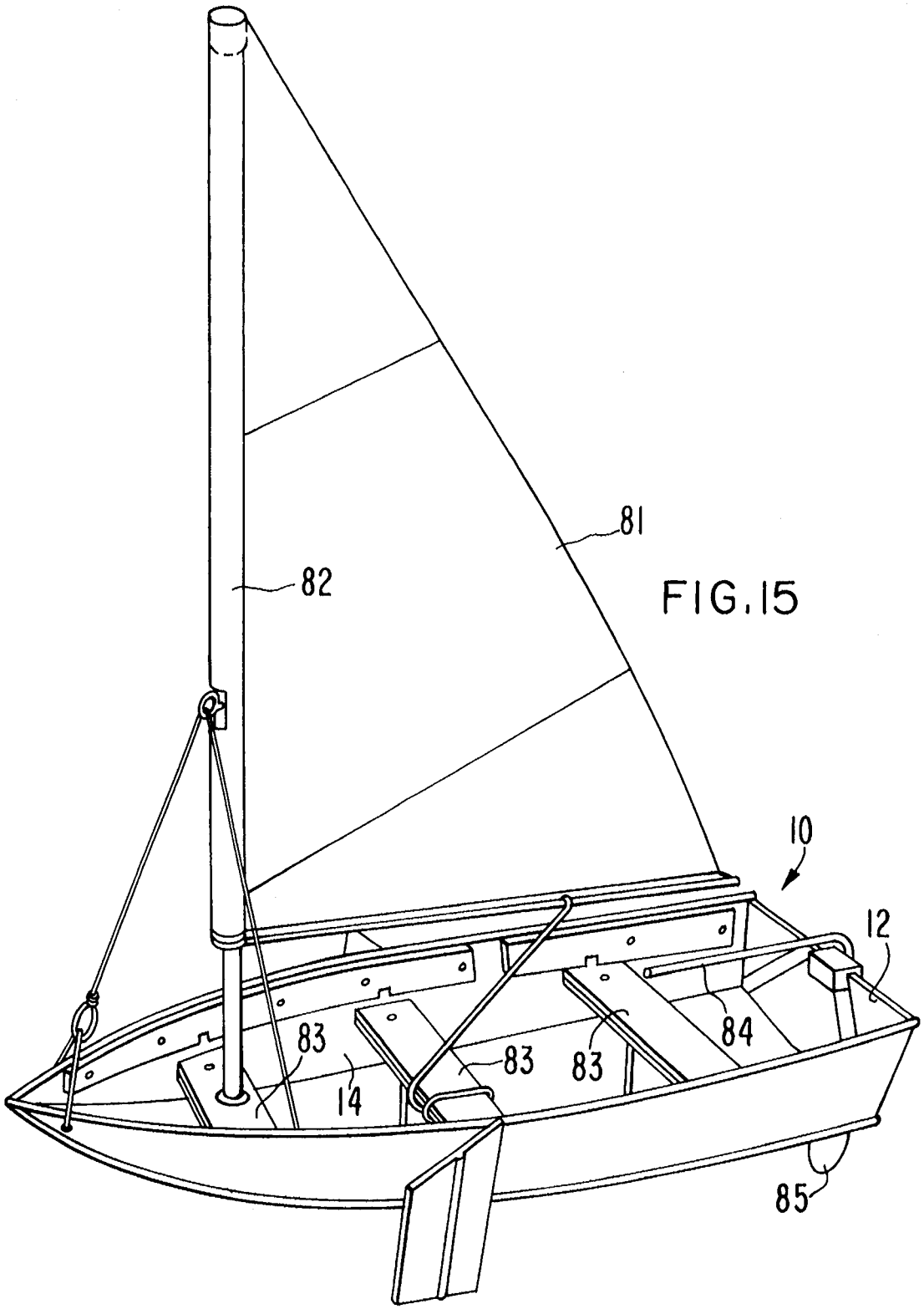
FIG. 15 is a perspective view of the collapsible boat when used as a sail boat.

FIG. 15 shows boat 10 in use as a sailboat having a sail 81 mounted on a mast 82 secured at the base of the mast on a seat 83. Other seats 83 can be provided on the interior of the boat, there being a tiller 84 for controlling a rudder 85. Diaphragm 12 may or may not be reinforced in the manner shown in FIG. 11. A tiller can be mounted in any suitable manner on diaphragm 12 such as by the motor mount shown in FIGS. 8–10 or the motor mount shown in FIGS. 12–14.

FIGS. 16–19 show a boat 10 having sides 14 and 16 and bottom panels 18 and 20 with hinge lines 22, 24 and 26. A diaphragm or transom 12 has a front lower edge provided with a projection 80 which fits within a groove 82 on elongated member 84 which is bonded to the upper surfaces of the bottom panels of the boat.

Member 84 is split fore and aft to accommodate the presence of hinge line 24 so that the boat with member 84 attached to it can articulate into the configuration shown in FIG. 3. Likewise, member 84 is split fire and aft to accommodate hinge lines 22 and 26. Member 84 has its slot 85 facing forwardly and extending from one side 14 to the opposite side 16 and similarly, a member 88 can extend upwardly along each of sides 14 and 16, respectively, and present a slot or groove 90 at each side for receiving a tongue or projection 92 on diaphragm 12.

Figure 16:
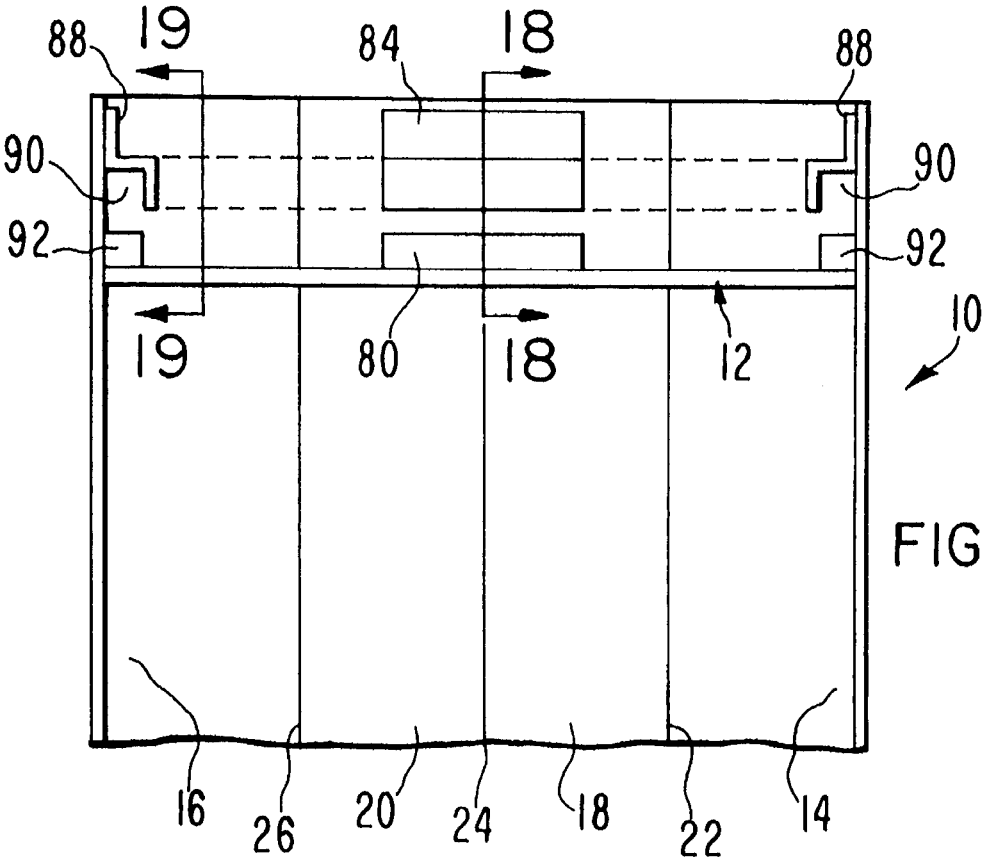
FIG. 16 is a top plan view of a rear, substantially rigid transom for a collapsible boat in which the transom is lowered onto the bottom panels of the boat and then moved rearwardly into a sealing, locking relationship with the boat bottom and side panels.
Figure 17:
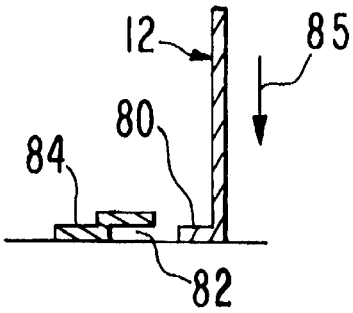
FIG. 17 is a cross-sectional view of the transom before it is moved laterally into locking relationship with the bottom panels of the boat.
Figure 19:
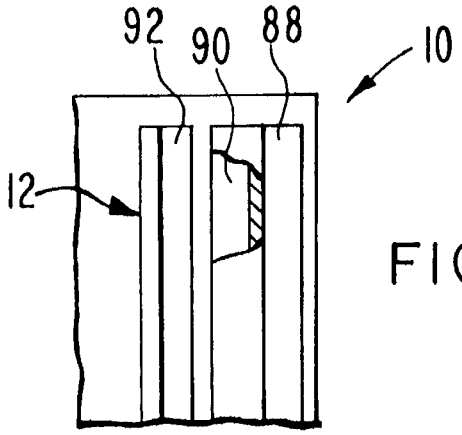
FIG. 19 is an elevational view of one side of the boat, showing the way in which the transom is moved into position locking a side panel of the boat to the transom.

FIGS. 16, 17 and 19 show the position of the diaphragm 12 when it is desired to lower the diaphragm into place aligned with bottom slot 82 and side slots 83. Thus, to couple the diaphragm 12 to the boat, the diaphragm is lowered into position as shown in FIG. 17 until the bottom of flange 80 engages the upper surface of the bottom panels 18 and 20. This lowering of the diaphragm is denoted by the numeral 85 in FIG. 17.

Figure 18:
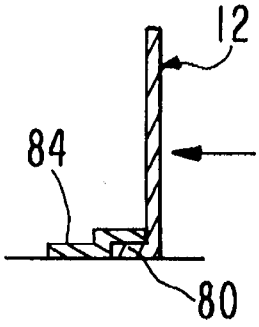
FIG. 18 is a view similar to FIG. 17 but showing the transom locked to the bottom panels of the boat.

Once in this position, the diaphragm 12 can then be pushed rearwardly so that flange 80 of diaphragm 12 will shift into slot 80 (FIG. 17) until the member 80 is in the position shown in FIG. 18. In this position, projection 80 is releasably received in slot 80 and in sealing relationship with the inner surface defining the slot 80. The projections 92 on diaphragm 12 at the two sides thereof are also in sealing relationship to inner surfaces defining slots 90. While the division of the members 84 and 86 must necessarily cross the hinge lines 22, 24 and 26, suitable sealing means, if necessary, can be provided where the hinge lines cross the mounting members 84 and 86. For instance, double backed adhesive tape segments could be used between members 84 and 86 and panels 14, 16, 18 and 20.

Figure 20:
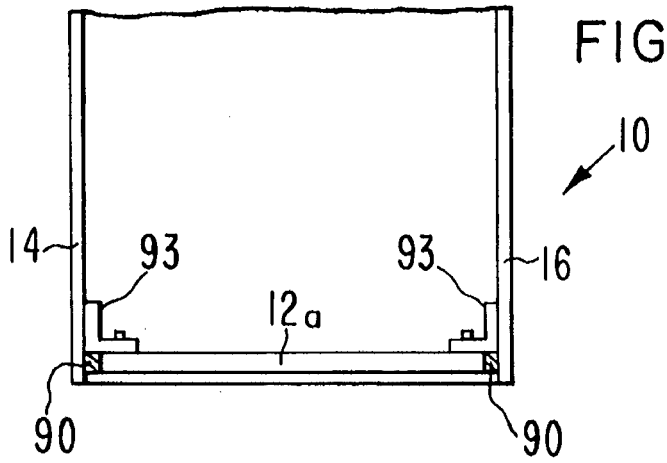
FIGS. 20 and 21 are fragmentary top plan and rear elevational views of a boat with another type of transom.
Figure 21:
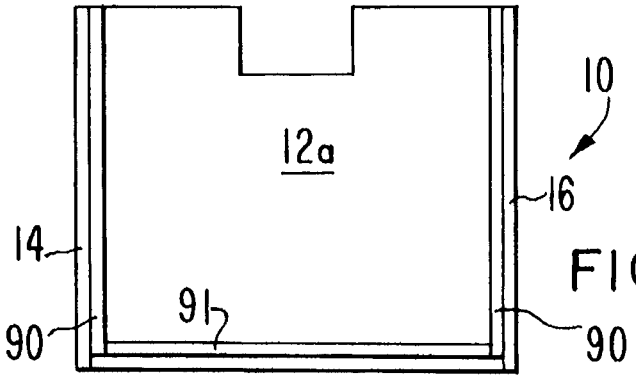

FIGS. 20 and 21 show another embodiment of the boat 10 in which a rigid transom 12*a* can be placed ahead of transom 12 which is yieldable as described above with respect to FIGS. 1 and 2. Transom 12*a* has a pair of side edges along with a foam seal strip 90 is secured for engagement with the inner surface of the adjacent side and bottom wall of the boat. Similarly, the opposite side of the transom 12*a* has a foam strip 90, and the bottom has a foam strip 91 as shown in FIG. 21.

Figure 22:
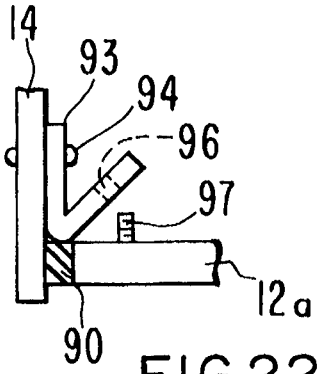
FIG. 22 is an enlarged, fragmentary view of the attachment means for the transom of the boat of FIGS. 20 and 21.

To retain transom 12*a* in place as shown in FIG. 20, a pair of living hinges 93 shown in detail in FIG. 22 is secured by fasteners 94 to the adjacent side wall 14 of the boat 10. Hinge 93 has a hole 96 for receiving a threaded bolt 97 carried by transom 12*a*. A nut is threaded onto the bolt 97 to secure the living hinge to the transom 12*a*.

The present invention provides an improved collapsible boat in which a flexible diaphragm can be folded with the boat and can be used to mount a motor on the boat at the rear thereof without interfering with the operation of the boat or the occupants of the boat.

Where suitable, such as in bonding plastic materials together, the Hellerbond process is preferably used. This process operates to join materials without depending upon the heat inducted from exterior surfaces. Rapid bonds of weld strength are accomplished with this process. Heat is generated directly at the interface by a magnetic field which reaches through the materials being joined, eliminating the need for heat transfer. This interior heat generation is particularly valuable for bonding thick, reinforced, dissimilar, heat-sensitive oriented materials. For instance, this process is suitable for bonding members 84 and 88 (FIGS. 16–18), to adjacent surfaces. Other locations on the various embodiments disclosed above can also be able to be bonded with the Hellerbond process.

I claim:

1. In a collapsible boat having a pair of bottom panels and a pair of side panels hinged to respective bottom panels, each panel having a rear margin:

a flexible diaphragm having fold lines to allow the diaphragm to fold into a substantially compact condition, said diaphragm having a bottom rear flange and a pair of side flanges;

means for stiffening the diaphragm;

means for coupling the flanges of the diaphragm to the rear margins of respective panels; and means for sealing the junctions between the rear margins of the panels and the flanges of the diaphragm to prevent leakage across said junctions while allowing the boat to collapse or expand;

wherein the diaphragm has a recess formed therethrough and a member being provided with a pair of spaced, generally parallel elements, a front element adapted to be secured to the seat and a rear element adapted to extend through the recess of the diaphragm, whereby a block can be placed on the rear element to thereby secure a motor thereto.

2. In a collapsible boat having a pair of bottom panels and a pair of side panels hinged to respective bottom panels, each panel having a rear margin:

a flexible diaphragm having fold lines to allow the diaphragm to fold into a substantially compact condition, said diaphragm having a bottom rear flange and a pair of side flanges;

means for stiffening the diaphragm;

means for coupling the flanges of the diaphragm to the rear margins of respective panels; and means for sealing the junctions between the rear margins of the panels and the flanges of the diaphragm to prevent leakage across said junctions while allowing the boat to collapse or expand;

wherein the diaphragm has a hole therethrough, and a seat having a pair of surfaces at right angles to each other, means pivotally mounting the seat on the boat for movement of one of the surfaces from a position generally horizontal to a position generally vertical across said hole of the diaphragm, whereby the first surface can be used as a seat when the member is horizontal and the surface can serve as a motor mount when the member is in the vertical position.

3. In a collapsible boat as set forth in claim 2, wherein is included one or more braces for releasably attaching the second surface across the opening of the diaphragm.

* * * * *